US005176245A

United States Patent [19]

Sekitani

[11] Patent Number: 5,176,245

[45] Date of Patent: Jan. 5, 1993

[54] CONVEYOR DEVICE FOR TRANSPORTING PEG TRAYS

[75] Inventor: Noboru Sekitani, Ohtsu, Japan

[73] Assignee: Murata Kikai Kabushiki Kaisha, Kyoto, Japan

[21] Appl. No.: 732,084

[22] Filed: Jul. 18, 1991

[30] Foreign Application Priority Data

Jul. 20, 1990 [JP] Japan ..... 2-76595[U]

[51] Int. Cl.[5] ..... B65G 37/00

[52] U.S. Cl. ..... 198/465.2; 198/465.3; 198/803.12; 242/35.5 A

[58] Field of Search ..... 198/803.12, 817, 465.3, 198/803.2, 465.2, 465.1; 242/35.5 A

[56] References Cited

U.S. PATENT DOCUMENTS 4,823,940 4/1989 Cretser ..... 198/817

FOREIGN PATENT DOCUMENTS 0314089 5/1989 European Pat. Off. ..... 198/803.12
2801526 7/1979 Fed. Rep. of Germany ..... 198/817
2175934 7/1990 Japan ..... 198/803.12

*Primary Examiner*—Robert P. Olszewski
*Assistant Examiner*—Cheryl L. Gastineau
*Attorney, Agent, or Firm*—Spensley Horn Jubas & Lubitz

[57] ABSTRACT

A conveyor device for transporting a peg tray carrying a bobbin thereon without being inclined during the transportation thereof. In a conveyor device in which a belt is arranged upright with respect to the direction of width thereof and a peg tray carrying a bobbin thereon is mounted on the edge portion of the belts to be transported by the belt, two belts are provided and arranged in such a way that they are in parallel with each other and the peg tray is mounted on each of the edge portions of the two belts.

15 Claims, 3 Drawing Sheets

CONVEYOR DEVICE FOR TRANSPORTING PEG TRAYS

FIELD OF THE INVENTION

The present invention relates to a conveyor device for transporting a tray with a peg, on which is mounted an article such as a bobbin, a package or the like uprightly.

RELATED ART STATEMENT

So far various conveyors of the type described above have been developed and used. A conventional conveyor is shown, as an example, in FIGS. 3-5 in which within a bent transporting path 31, a belt 32 is extended in the upright state with respect to the direction of width thereof and is moved by the guide rollers 33 by one of which is drived by a motor or the like to move the belt 32. The belt conveyor 40 comprising the belt 32 is interposed between a winder 34 and a transporting passage 35, and an empty bobbin 36 ejected from the winder 34 is carried on a peg tray 37 and transported by a conveyor belt 38. The empty bobbin 36 is mounted on an edge portion 41 of the belt 32 uprightly mounted of the conveyor 40, and is transported along and guided by a guide groove 42. The guide groove 42 is provided to be bent so as to be connected to the guide groove 42 of a conveyor belt 43 in the transporting passage 35 which is arranged to be opposed toward the bobbin taking in or out side of the conveyor 40. The empty bobbin 36 is, therefore, transferred on and transported by the conveyor belt 43. The peg tray 37 carrying a spinning bobbin 45, which is mounted on a conveyor belt 44 in the transporting passage 35 is transferred on the edge portion 41 of the belt 32 of the conveyor 40 and transported toward the winder 34. The peg tray 37 carrying the spinning bobbin 45 is transferred on a conveyor 46 of the winder 34 and is transported to one of units of the winder 34.

The belt 32 is guided by guide plates 47 and 48 at both sides thereof and the guide plates 47 and 48 support one sides of floor plates 50 which are disposed at the positions lower than the edge portion 41 of the belt 32.

In the case of the conventional conveyor of the type described above, as best shown in FIG. 5, the width of the upright edge portion 41 of the belt 32 is narrow so that the peg tray 37 is not transported by only being supported by the edge portion 41 but a part of a bottom face 51 of the peg tray 37 is supported by the floor plate 50 so that the peg tray is transported in the inclined state. As a result, the peg tray 37 carrying a bobbin is caused to be rotated around the point of contact 52 between the bottom face 51 of the peg tray 37 and the floor plate 50. Furthermore, not only due to the friction produced at the contact point 52 but also the moving state of the peg tray 37, the latter often slides at the contact point 52. As described above, the conventional conveyor of the type described above has not only the defect that the moving speed of the bobbin becomes slower than that of the belt 32 but also the defect that the resistance against the transportation of the bobbin is increased to increase the energy for transportation. Such defects are more pronounced especially when the quantity of the yarn wound around is increased and recently due to the increase in size of a package, such defects increasingly become remarkable.

OBJECT AND SUMMARY OF THE INVENTION

It is an object of the present invention to provide a device for transporting a bobbin stably without being inclined a tray carrying the bobbin during the transportation thereof.

The present invention has been made to solve the above and other defects or problems encountered in the conventional belt conveyers of the type described above.

According to the present invention, in a conveyor device in which a belt is arranged upright with respect to the direction of width thereof; a peg tray is mounted on an edge portion of the belt; and the peg tray carrying a bobbin vertically supported thereon is transported by the belt being guided by a guide groove, two belts are provided and arranged in such a way that they are in parallel with each other and are spaced apart from each other by a suitable distance, and the peg tray is mounted on the edge portion of each of the two belts so that when two belts are driven, the bobbin is transported, whereby the transportation efficiency of the bobbin can be considerably increased.

The two belts are guided by the guide rollers, and are regulated and arranged in upright position and in parallel relationship with each other being spaced apart from each other by a suitable distance by side plates. The belts are driven by a motor through one of the guide rollers. The peg tray with an empty bobbin which is ejected by a transporting passage from a unit is mounted on the edge portion of each belt of the conveyor device to be, moved with the belt, and then the peg tray is transferred to another transporting passage. On the other hand, the peg tray upon which is mounted a spinning bobbin upright is transferred to the conveyor device and is subjected to the yarn treating operation. Thereafter the spinning bobbin is transferred to a transporting passage to feed a spinning bobbin to a unit conveyor.

BRIEF DESCRIPTION OF THE DRAWINGS

FIGS. 1 and 2 illustrate the embodiments, respectively, of the present invention;

FIG. 3 is a perspective view illustrating the transportation by a conveyor and the state of transportation;

FIG. 4 is a schematic view illustrating the whole construction of the conveyor; and FIG. 5 is a sectional view thereof.

DETAILED DESCRIPTION OF PREFERRED EMBODIMENTS

Figure 1A:
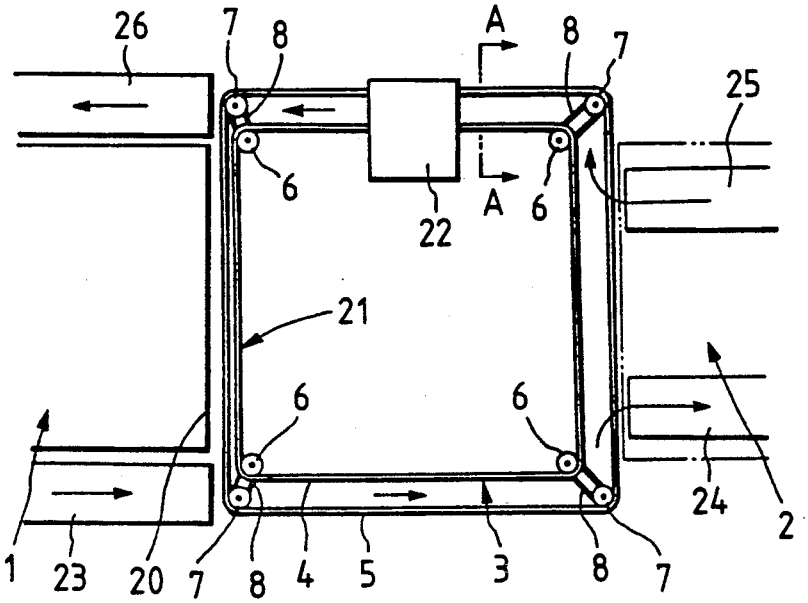
FIG. 1*a* is a schematic view illustrating the whole construction for transporting a spinning bobbin and an empty bobbin.
Figure 2A:
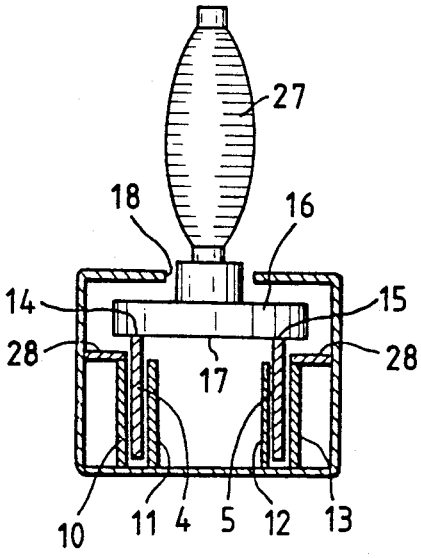
FIG. 2*a* is a sectional view taken along the line A—A of FIG. 1*a;*

A first embodiment of the present invention will be described referring to FIG. 1*a* and FIG. 2*a*.

A conveyor 3 interposed between a unit 1 such as a winder and a transporting conveyor 2 comprises two belts 4 and 5. Each of belts 4 and 5 is arranged in the upright state with respect to the direction of width thereof as in the case of the conventional conveyors, and the belts 4 and 5 are arranged in parallel with each other. The inner conveyor belt 4 which runs inside of the conveyor 3 is guided by inner guide rollers 6 while the outer conveyor belt 5 which runs outside of the conveyor 3 is guided, by outer guide rollers 7. The inner guide roller 6 and outer guide rollers 7 opposing each other are interconnected to each other by a belt 8, and are so designed and constructed as to be rotated together. Therefore, both of the inner conveyor belt 4 and the outer conveyor belt 5 are smoothly moved in synchronized relationship when one of the inner and outer guide rollers 6 and 7 is driven by one motor.

The inner conveyor belt 4 is guided by side plates 10 and 11 on both sides thereof while the outer conveyor belt 5 is guided by side plates 12 and 13 and they are always moved in such a manner that they are regulated in the upright state and in parallel with each other and are spaced apart from each other by a suitable distance.

A bottom face 17 of a peg tray 16 is mounted on an edge portion 14 of the inner conveyor belt 4 and an edge portion 15 of the outer conveyor belt 5 which are so arranged as mentioned above. The peg tray 16 is guided by a guide groove 18 as in the case of the conventional conveyor. The space between the inner conveyor belt 4 and the outer conveyor belt 5 is set to be constant in a range of transportation of a bobbin, while the space between the inner conveyor 4 and the outer conveyor belt 5 is set to be narrower than the space in the range of transportation at a conveyor line 21 which opposes to the bobbin taking-in and taking-out side of the unit 1, where a bobbin is not transported. A yarn end finding device 22 is disposed at one position of the conveyor 3.

In the device so constructed as described above, the peg tray 16 which carrys uprightly an empty bobbin ejected by the taking-out conveyor 23 of the unit 1 is transferred on the edge portions of the inner conveyor belt 4 and the outer conveyor belt 5 and is transported thereby. As in the case of the conventional conveyor, the peg tray 16 is guided by the guide groove 18 and then transferred to a first conveyor 24 of the transporting conveyor 2 to be fed to the next stage. On the other hand, the peg tray 16 which carries uprightly a spinning bobbin and is transported by a second conveyor 25 of the transporting conveyor 2 is guided by the guide groove 18 and transferred onto the conveyor 3 in a manner substantially similar to that described above. In the yarn end finding device, the leading end of the yarn wound around the spinning bobbin is drawn out, wound around a take-up tube of the bobbin, and then hanged down into the take-up tube. The spinning bobbin treated by the yarn end finding device is transferred onto a taking-in conveyor 26 of the unit 1 and is transported. When the peg tray 16 is taken out from the unit 1 or the peg tray 16 is taken in to the unit 1, the peg tray 16 is easily transferred between the conveyors since the space between the inner conveyor belt 4 and outer conveyor belt 5 of the conveyor 3 is set to be narrow as mentioned above. The bobbin 27 which is carried on the edge portions of two conveyor belts may be stably transported without falling down and the end of the bottom face 17 of the peg tray 16 never contact with the floor plate 28.

Figure 1B:
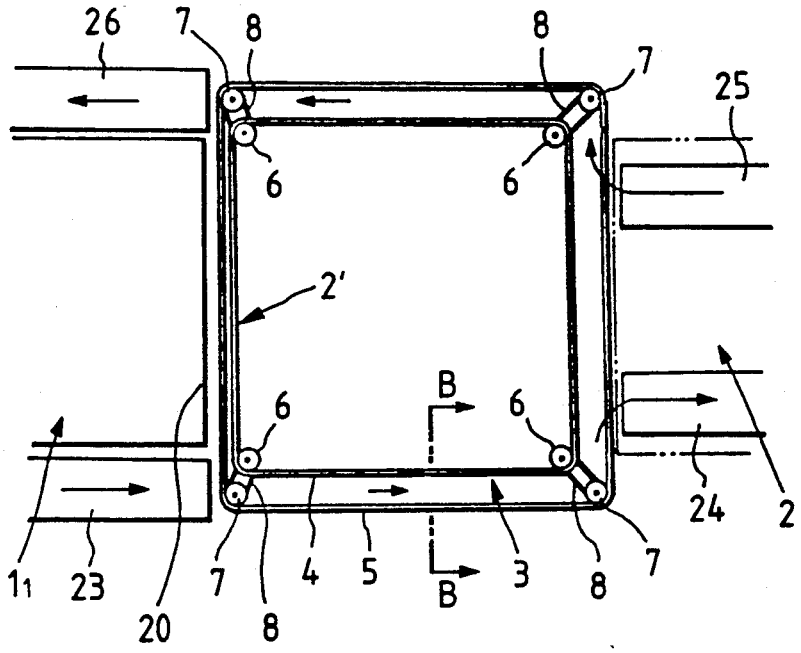
FIG. 1*b* is a schematic view illustrating the transportation of cheese or corn and a paper tube or a wood tube.
Figure 2B:
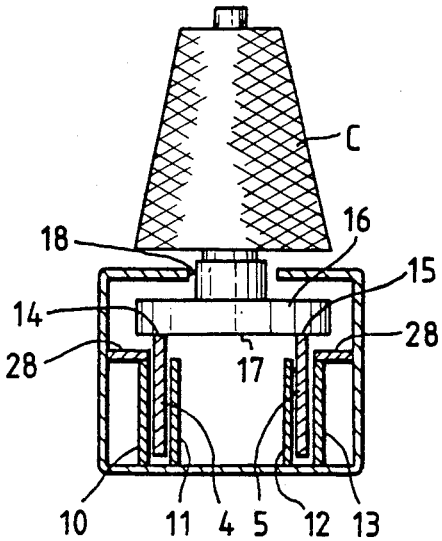
FIG. 2*b* is a sectional view taken along the line B—B of FIG. 1*b;*
Figure 3:
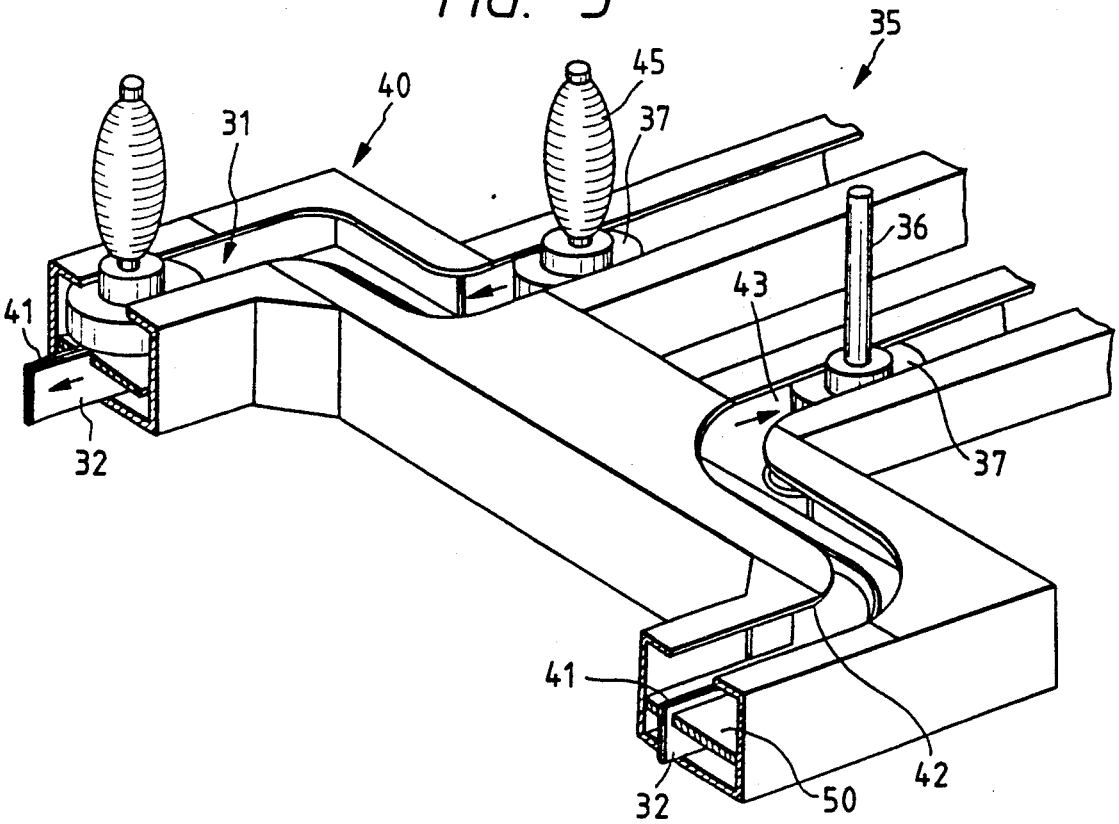
FIGS. 3-5 show a conventional conveyor.
Figure 4:
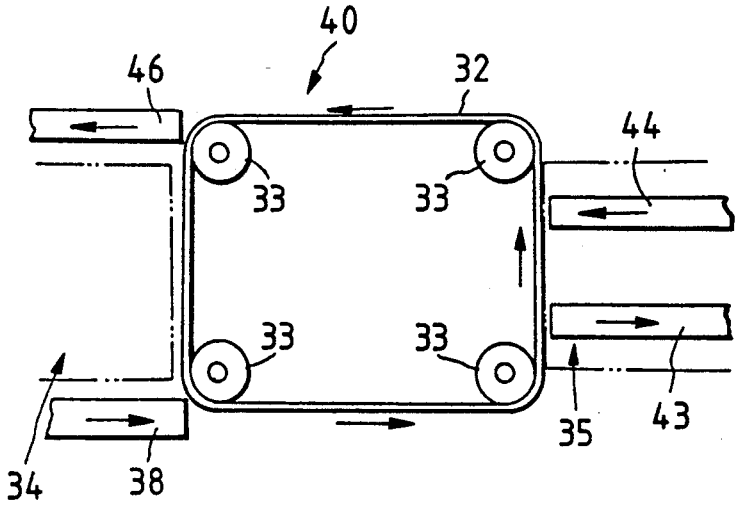
Figure 5:
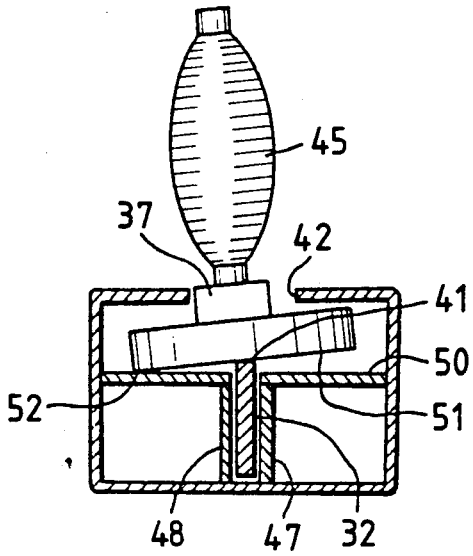

The conveyor device of the present invention may be used for the transportation of a corn or cheese as will be described hereinafter as a second embodiment with reference to FIG. 1*b* and FIG. 2*b*. The peg tray 16 which carrys a cone or cheese C and is ejected by the taken-out conveyor 23 of the winder unit 1, is transferred onto the edge portion 14 of the inner conveyor belt 4 and the edge portion 15 of the outer conveyor belt 5 of the conveyor 3. The peg tray 16 is guided by the guide groove 18 and is transferred onto the first conveyor 24 of the transporting conveyor 2 to be supplied to the next step. While, the peg tray 16 which carries a paper tube or wood tube and is transported by the second conveyor 25 of the transporting conveyor 2, is guided by the guide groove 18 and is transferred onto the conveyor 3 in the same manner as described above. This paper tube or wood tube is transferred onto the taking-in conveyor 26 of the winder unit 1 and is transported.

The conveyor in accordance with the present invention is designed and constructed in the manner described above. Therefore, the peg tray 2 is mounted on the edge portions of two conveyor belts which are arranged upright and in parallel with each other. As a result, the present invention can solve the problems of the conventional conveyors that the peg tray is inclined so that one portion of the bottom face of the peg tray is come into contact with the floor plate, resulting the rotation of the bobbin and that the bobbin transportation speed becomes slower than the speeds of the belts by dragging. Furthermore, the increase in energy consumed due to the increase of the frictional resistance by the above-mentioned contact can be prevented.

What is claimed is:

1. A conveyor device, comprising:

a first moveable endless conveyor belt defining an edge and a run, a second moveable endless conveyor belt defining an edge and a run, the entire run of the first moveable conveyor belt being located within the entire run of the second moveable conveyor belt, a peg tray configured to carry an article thereon, the first and second conveyor belts being in mutually spaced, substantially parallel relationship, the peg tray being in simultaneous friction contact with the edge of the first conveyor belt and the edge of the second conveyor belt, whereby movement of the first and second conveyor belts causes movement of the peg tray.

2. A conveyor device, comprising:

a first moveable endless conveyor belt defining an edge, a second moveable endless conveyor belt defining an edge, a peg tray configured to carry an article thereon, the first and second conveyor belts being in mutually spaced, substantially parallel relationship, the peg tray being in simultaneous friction contact with the edge of the first conveyor belt and the edge of the second conveyor belt, a first guide roller for guiding the first conveyor belt a second guide roller for guiding the second conveyor belt, a guide roller belt for operatively connecting and rotating the first and second guide rollers in tandem, whereby movement of the first and second conveyor belts causes movement of the peg tray.

3. A conveyor device comprising:

a first moveable endless conveyor belt defining an edge, a second moveable endless conveyor belt defining an edge, a peg tray configured to carry an article thereon, the first and second conveyor belts being in mutually spaced, substantially parallel relationship, the peg tray being in simultaneous friction contact with the edge of the first conveyor belt and the edge of the second conveyor belt, wherein a portion of the conveyor device is positioned substantially adjacent a winder, wherein the first and second conveyor belts define a substantially constant mutual spacing, and wherein the mutual spacing between the first and second conveyor belts is relatively narrower in the portion of the conveyor device positioned substantially adjacent the winder, whereby movement of the first and second conveyor belts causes movement of the peg tray, and whereby transfer of the peg tray between the conveyor device and the winder is improved.

4. The conveyor device as claimed in claim 1, wherein the peg tray is configured to carry a bobbin.

5. The conveyor device as claimed in claim 1, wherein the peg tray is configured to carry a cone.

6. The conveyor device as claimed in claim 1, wherein the peg tray is configured to carry a cheese.

7. The conveyor device as claimed in claim 2, wherein the two belts are arranged and regulated in an upright orientation by two side plates.

8. The conveyor device as claimed in claim 3, wherein the peg tray is configured to carry a bobbin.

9. The conveyor device as claimed in claim 3, wherein the peg tray is configured to carry a cone.

10. The conveyor device as claimed in claim 3, wherein the peg tray is configured to carry a cheese.

11. The conveyor device as claimed in claim 3, wherein the two belts are arranged and regulated in an upright orientation by two side plates.

12. The conveyor device as claimed in claim 1, wherein the peg tray is configured to carry a bobbin.

13. The conveyor device as claimed in claim 1, wherein the peg tray is configured to carry a cone.

14. The conveyor device as claimed in claim 1, wherein the peg tray is configured to carry a cheese.

15. The conveyor device as claimed in claim 1, wherein the two belts are arranged and regulated in an upright orientation by two side plates.

* * * * *